US005573340A

United States Patent [19]

Gueret

[11] Patent Number: 5,573,340

[45] Date of Patent: Nov. 12, 1996

[54] DEVICE FOR DISPENSING A LIQUID OR POWDERY PRODUCT

[75] Inventor: Jean-Louis Gueret, Paris, France

[73] Assignee: L'Oreal, Clichy Cedex, France

[21] Appl. No.: 377,079

[22] Filed: Jan. 26, 1995

[30] Foreign Application Priority Data

Feb. 4, 1994 [FR] France ..... 94 01265

[51] Int. Cl.[6] ..... A45D 34/00; A45D 40/20

[52] U.S. Cl. ..... 401/126; 401/119; 401/130; 401/125

[58] Field of Search ..... 401/119, 123, 401/125, 126, 130; 132/298, 299, 306, 307

[56] References Cited

U.S. PATENT DOCUMENTS

| | | | |
|---|---|---|---|
| 1,460,243 | 6/1923 | Harvey . | |
| 1,922,326 | 8/1933 | Rauber et al. | 132/306 |
| 2,790,984 | 5/1957 | Gilpin | 401/125 |
| 3,009,217 | 11/1961 | Weiner . | |
| 3,951,157 | 4/1976 | Idec | 401/130 X |

FOREIGN PATENT DOCUMENTS

| | | | |
|---|---|---|---|
| 0354823 | 2/1990 | European Pat. Off. . | |
| 0490449 | 6/1992 | European Pat. Off. . | |
| 88816 | 4/1896 | Germany . | |
| 18768 | 12/1888 | United Kingdom | 401/125 |

*Primary Examiner*—Steven A. Bratlie

*Attorney, Agent, or Firm*—Finnegan, Henderson, Farabow, Garrett & Dunner

[57] ABSTRACT

A device for dispensing a liquid or powdery product is disclosed. This device includes a container and a stopper for sealing the container. A pouch made of a deformable elastic substance and including at least one slit is placed within the neck of the container. The slit on the pouch is closed when the stopper is removed from the container to prevent product from accidentally escaping from the container. When the stopper seals the container an applicator on the stopper fits within the pouch and applies a force to a wall of the pouch to open the slit. Thus the applicator may be impregnated with the product when the stopper seals the container.

32 Claims, 4 Drawing Sheets

DEVICE FOR DISPENSING A LIQUID OR POWDERY PRODUCT

BACKGROUND 0F THE INVENTION

The present invention relates to a device for dispensing a liquid or powdery product. More particularly, the present invention relates to a device including a product container having a neck and a stopper for sealing the neck. When the stopper is placed in a sealed position with the container an applicator member positioned on the stopper is immersed in the container.

The applicator member may be impregnated with the product when the container is sealed, for example, by shaking or inverting the container to promote contact between the applicator member and the product. The stopper is then removed from the container and the applicator member, impregnated with product, is used to apply product to a desired place.

It has been proposed to apply a product with a device where the neck of the container remains open during the application process, however this approach has many shortcomings. Not only does the product within the container remain exposed to the atmosphere, but also the product may be spilled unintentionally if the container is knocked over or falls. In light of the foregoing there is a need for an improved device for applying a product.

SUMMARY 0F THE INVENTION

Accordingly, the present invention is directed to a device that substantially obviates one or more of the limitations of the related art.

An object of the invention, above all, is to provide a device including a container having a neck and a stopper equipped with an applicator member for dispensing a liquid or powdery product, which, while allowing the applicator member to be impregnated and reloaded correctly with product when the neck of the container is sealed by the stopper, eliminates practically any risk of unintentional spilling of the product when the stopper is removed from the neck of the container.

According to the invention, a device for dispensing a liquid or powdery product includes a container having a neck equipped with a pouch made of a deformable elastic substance in which an applicator member becomes housed when a stopper is fixed to the neck of the container. This pouch has at least one slit which is substantially closed at rest but capable of opening when the wall of the pouch is subjected to a thrust force applied by the applicator member when the stopper is in a normal sealed position.

The thrust force exerted by the applicator member on the wall of the pouch in the sealed position of the stopper may include a component orthogonal to the axis of the neck of the container. The slit or slits provided in the wall of the pouch may have a component situated in the same plane as the axis of the pouch. The applicator member may have transverse dimensions, such that, when the container is sealed with the aid of the stopper, the applicator member causes the wall of the pouch to swell out sideways and open the slit or slits.

The pouch may have a frustoconical shape and the slit or slits may be oriented along generatrices of the frustoconical surface.

In the sealed position of the stopper, the thrust force of the applicator member on the wall of the pouch may comprise a component oriented along the axis of the neck of the container, while the slit or slits have a component in a direction orthogonal to the axis of the pouch. This arrangement is such that in the sealed position of the stopper the applicator member abuts against the bottom of the pouch to create the above-mentioned thrust force and cause the slit or slits to open.

The slits of the pouch may have a V-shape, where the V-shape of the slit is substantially symmetrical relative to a plane including the axis of the pouch and a tip of the V-shape. Advantageously the tip of the V-shape may point towards the outlet of the container.

According to another possibility, the slits may have the shape of an arc of a curve having an average direction orthogonal to the axis of the pouch.

The wall of the pouch may have a region of reduced thickness in a plane substantially orthogonal to the axis and the slit or slits may be provided in this region.

The region of reduced thickness of the pouch may form a groove to create a reserve for the product and the slits may be provided in the bottom of this groove.

Additionally, the pouch may have the shape of a substantially cylindrical thimble with a rounded internal end.

As a variant, the pouch and the applicator member may have a planar frustoconical shape or a planar shape tapered like an ice lolly.

It is to be understood that both the foregoing general description and the following detailed description are exemplary, and are intended to provide further explanation of the invention as claimed. The accompanying drawings are included to provide a further understanding of the invention and are incorporated in and constitute a part of this specification. The drawings illustrate embodiments of the invention and, together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings.

Figure 1:
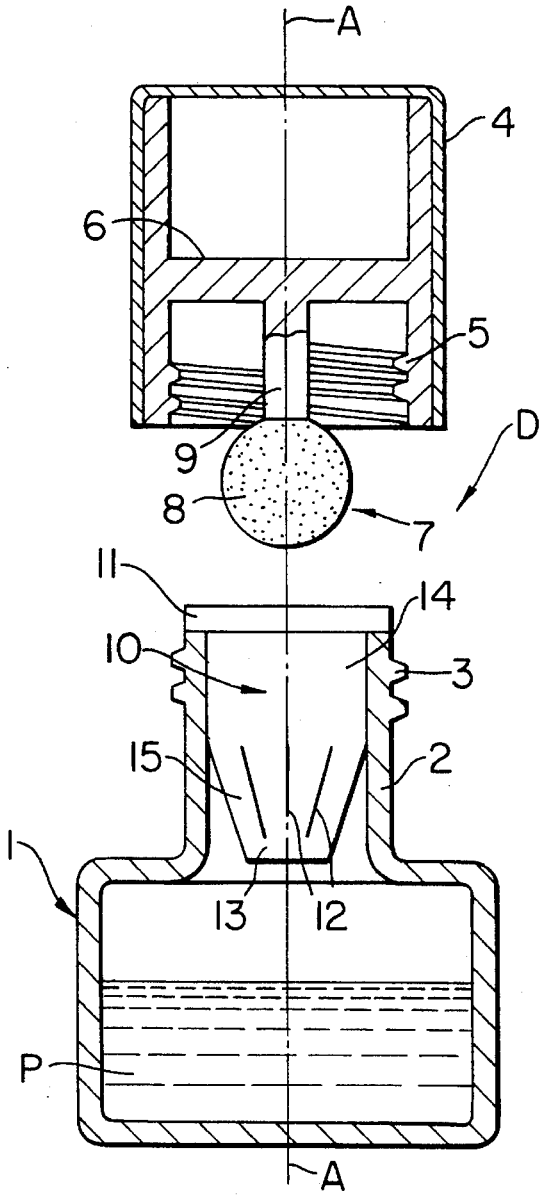
FIG. 1 is a partial cross sectional view, with parts viewed from the outside, of a device in a first embodiment of the invention, wherein the container is open and the stopper is away from the neck.
Figure 2:
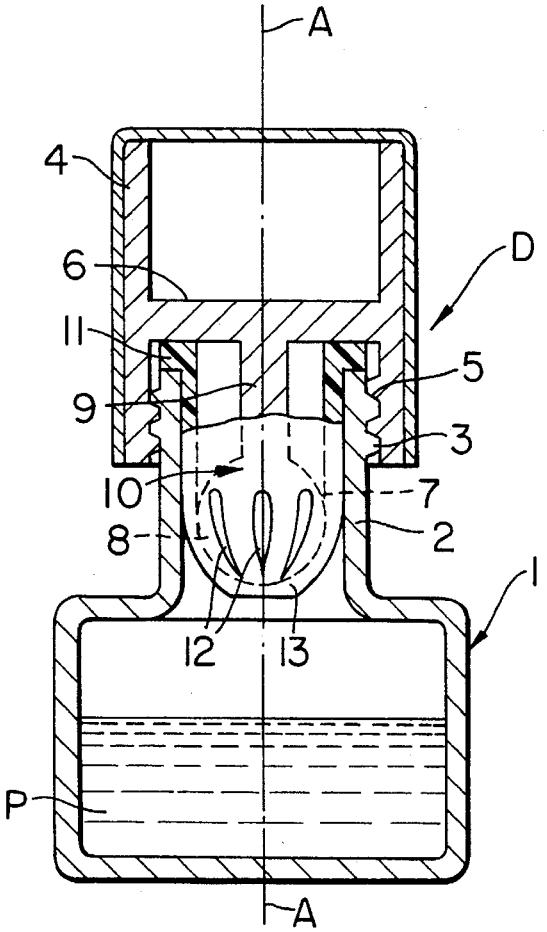
FIG. 2 is a partial cross sectional view of the device of FIG. 1 showing the pouch with the slits open from the thrust of the applicator member when the stopper is in the sealed position.

Referring to the drawings, especially to FIGS. 1 and 2, a device D for dispensing a liquid or powdery product P is depicted. This device D includes a container 1 for a product P. The container 1 may consist of a flask, for example a glass flask, and is equipped with a neck 2 or mouth of relatively large diameter having an external screw thread 3. A stopper 4 with an internal screw thread 5 able to cooperate with the screw thread 3 of the neck 2 is provided for sealing the container 1. In this embodiment, the stopper 4 includes a transverse wall 6 which is applied in a sealed fashion against the end of the neck 2.

The stopper 4 has an applicator member 7 that is capable of being immersed in the container 1, substantially at the level of the neck 2 when the stopper 4 is in the sealed position, as illustrated in FIG. 2. The applicator member 7 includes a wad 8 carried on the lower end of a rod 9 that is integral and coaxial with the stopper 4. In this embodiment the rod 9 is integral with the transverse wall 6 and coaxial with the neck 2 when the stopper 4 is in the sealed position as illustrated in FIG. 2.

The wad 8 may be made of an elastomeric substance, a flocked plastic substance, felt, foam, or of any other equivalent substance which is capable of being impregnated with the product P and capable of applying it.

The neck 2 of the container 1 is equipped with a pouch 10 made of a deformable elastic substance, preferably an elastomeric material. The applicator member 7 becomes housed in the pouch 10 when the stopper 4 is fixed to the neck 2 of the container 1. At its upper end the pouch 10 includes a collar 11 projecting radially outwards and forming a rim which comes to bear axially against the end of the neck 2. When the stopper 4 is threaded onto the neck 2 of the container 1 in the sealed position shown in FIG. 2, the transverse wall 6 of the stopper 4 contacts and compresses the elastic collar 11. Thus the collar 11 forms a seal for the neck 2 of the container 1 to prevent the escape of product P.

The pouch 10 is also furnished with at least one slit 12 which is closed in an at rest position, that is to say when the stopper 4 is removed, as shown in FIG. 1. In the example of FIGS. 1 and 2, several slits 12 are uniformly spaced around the axis of the pouch 10. When the stopper 4 is in the normal, sealed, position as illustrated in FIG. 2, the slits 12 open because the wall of the pouch 10 is subjected to a thrust force applied by the applicator member 7.

The bottom 13 of the pouch 10 is closed. It is immediately clear that in the at rest position, that is to say when the stopper 4 is removed as illustrated in FIG. 1, the inside of the container 1 is isolated from the outside by the pouch 10 because slits 12 are closed. Thus the product P cannot escape when the stopper 4 is removed from the container 1, even if the container 1 is knocked over.

The pouch 10 includes a cylindrical upper part 14 engaged tightly in the upper part of the neck 2 and a lower part 15 which, in the at rest position (as shown in FIG. 1), has a frustoconical shape with a small base formed by the bottom 13 of the pouch 10. The slits 12 are provided in this part 15 and are oriented along the generatrices of the frustoconical surface. The slits 12 are therefore situated in planes including the axis of the pouch 10.

The thrust force exerted by the applicator member 7, more precisely by the wad 8, on the wall of the pouch 10 in the sealed position of the stopper 4 (as shown in FIG. 2) comprises a component orthogonal to the axis A—A of the neck 2 of the container 1. The applicator member 7 in the region of its wad 8 has transverse dimensions such that when the container 1 is closed with the aid of the stopper 4, this applicator member 7 causes the wall of the pouch 10 to swell out sideways in the region of the part 15 and causes the slits 12 to open as illustrated in FIG. 2. The wad 8 may have a substantially spherical shape and the diameter of this wad 8 may be on the order of the internal diameter of the large base of the frustoconical part 15, so that when the device is in the sealed position the wad 8 is pushed into the frustoconical part 15 causing it to swell out. The length of the rod 9 is selected so that the wad 8 remains set back slightly or just in contact with the inner surface of the bottom wall 13 of the pouch. Thus the bottom wall 13 is subjected to virtually no stress in a direction parallel to the axis A—A.

When the stopper 4 is in the sealed position (as shown in FIG. 2) it is possible to impregnate the wad 8 with the product P by shaking or inverting the container 1. The product P comes into contact with the wad 8 through the open slits 12.

Figure 3:
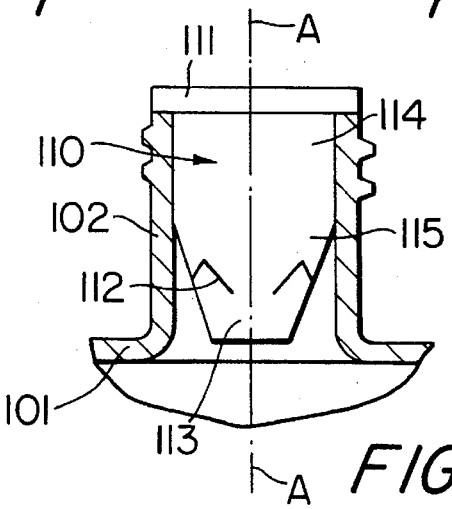
FIG. 3 illustrates a partial cross sectional view of another embodiment of the invention having a pouch with slits in the sealed position.
Figure 4:
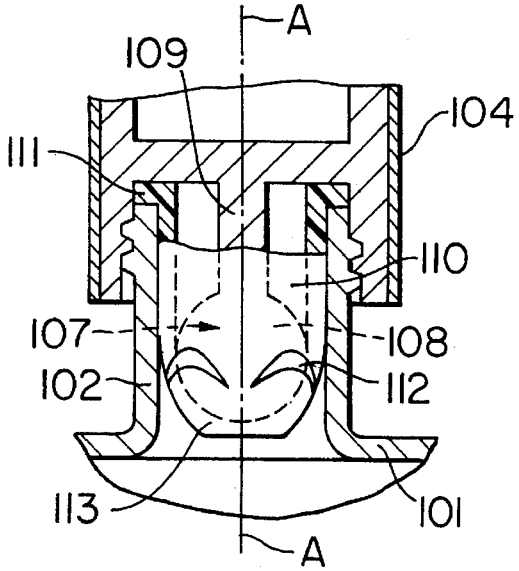
FIG. 4 illustrates a partial cross sectional view of the device of FIG. 3 with the pouch being subjected to the action of an applicator member so that the slits are open.

FIGS. 3 and 4 illustrate another embodiment in which those elements which are identical to, or fulfil similar roles to, elements already described with regard to FIGS. 1 and 2 are denoted by reference numerals which are similar to those of FIGS. 1 and 2 but increased by one hundred. The same procedure will be adopted for the variants of the following Figs., with progressive increase of the numeral in increments of one hundred.

As shown in FIGS. 3 and 4, a pouch 110 includes slits 112 having a V-shape with a tip of the V-shape pointing towards the outlet of a container 101, that is to say upwards when the container 101 is in a normal position. The V-shape is substantially symmetrical relative to a plane including the axis A—A of the mouth or neck 102 of the container 101. Additionally the V-shape may be substantially symmetrical relative to a plane including the axis of the pouch 110 and a tip of the V-shape. The slits 112 are not situated entirely in planes including the axis A—A or the axis of the pouch 110, and therefore have a component in a direction orthogonal to the axis A—A and to the axis of the pouch 110. Note that the slits 112 also have a component in the direction of the axis A—A.

As in the embodiment of FIGS. 1 and 2, the pouch 110 has a lower part 115 of frustoconical shape closed at its small base by a bottom 113. The length of a rod 109 of an applicator member 107 is such that in the sealed position of a stopper 104, as illustrated in FIG. 4, the applicator member 107 abuts against the bottom 113 and exerts a stress or thrust force which substantially has a component oriented along the axis A—A of the neck 102 of the container 101. This stress, produced when the container 101 is sealed by the stopper 104, opens the slits 112. FIG. 4 illustrates the slits 112 partially open.

Additionally, the transverse dimensions of the applicator member 107 may be sufficient to cause the wall of the pouch 110 to swell out sideways in the region of the part 115, thus contributing also to the partial or complete opening of the slits 112.

In the at rest position, as illustrated in FIG. 3, the slits 112 are closed and the product cannot leave the container 101.

Figure 5:
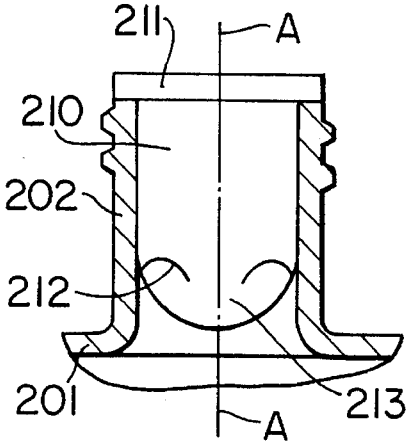
FIG. 5 illustrates a partial cross sectional view of another embodiment of the invention having a pouch with slits in the closed position.
Figure 6:
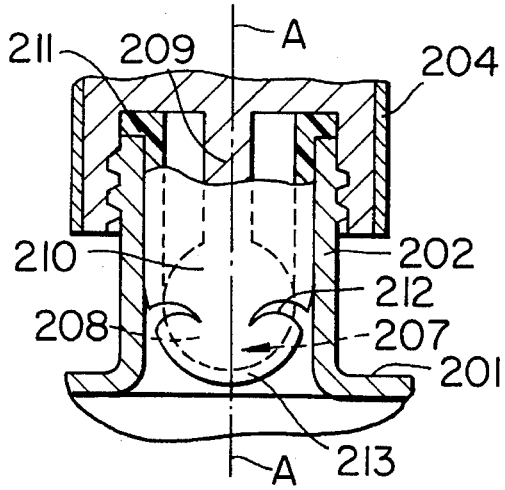
FIG. 6 shows a partial cross sectional view of the device of FIG. 5 with the slits of the pouch being opened by an applicator member.

FIGS. 5 and 6 illustrate another embodiment of the invention. In this embodiment slits 212 in a pouch 210 have the shape of an arc of a curve, for example a circular arc, with a convexity pointing towards an outlet orifice of a neck 202 of a container 201. The average direction of the curve of the slits 212 is orthogonal to the axis of the pouch 210. The bottom 213 of pouch 210 is substantially hemispherical, unlike the preceding examples where the lower part was frustoconical.

When a stopper 204 is in the sealed position, as illustrated in FIG. 6, the applicator member 207 exerts an axial thrust against the bottom 213 of the pouch 210, which opens the slits 212; it is then possible to impregnate a wad 208 of applicator member 207 with product P by shaking or inverting the container 201.

Figure 7:
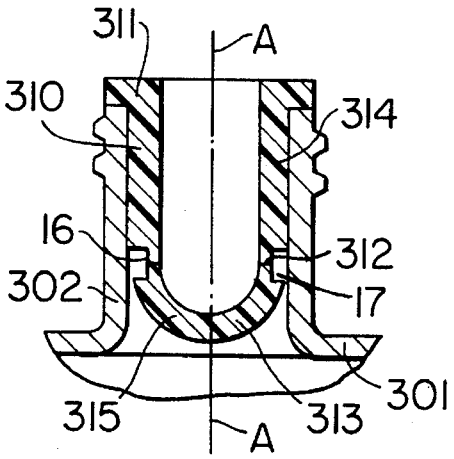
FIG. 7 is a cross sectional view of another embodiment of invention having a pouch including a peripheral groove and a thinned wall at the bottom of the groove, wherein the slits are closed.
Figure 8:
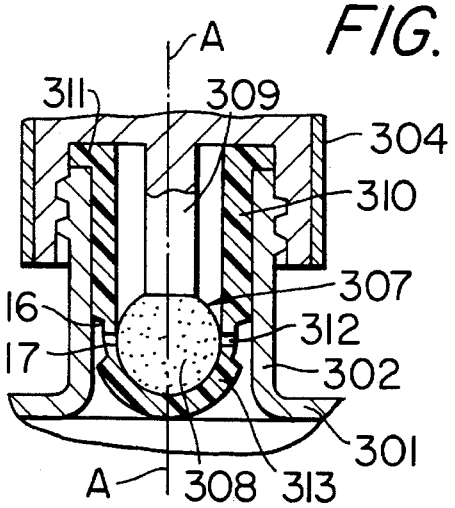
FIG. 8 shows in partial cross section the pouch of Fig. 7 with the slits opened by an applicator member.

FIGS. 7 and 8 illustrate another embodiment of the invention in which a pouch 310 has an overall cylindrical shape and includes a cylindrical upper part 314 and a substantially hemispherical lower part 315. The wall of the pouch 310 has a region 16 of reduced thickness defined by a groove 17 situated substantially at the junction of the lower part 315 and the upper part 314. The average plane of the groove 17 is orthogonal to the axis of the pouch 310, where this axis is coincident with the axis A—A of a neck 302. The groove 17 constitutes a reserve for product to improve impregnation of the applicator member 307.

Uniformally spaced slits 312 in the pouch 310 are situated in the bottom of the groove 17 also in a plane orthogonal to the axis of the pouch 310. By way of example, the slits 312 may be two in number and diametrically opposed with each slit 312 extending over approximately 45°.

When the stopper 304 is in the sealed position, as illustrated in FIG. 8, the thrust force exerted by the applicator member 307 is oriented substantially along axis A—A of the neck 302 of the container 301 and the applicator member 307 exerts a downwards pressure against the bottom 313 of the pouch 310 to open slits 312.

As illustrated in FIG. 7, in the at rest position when the stopper 304 is removed, slits 312 are closed.

Figure 9:
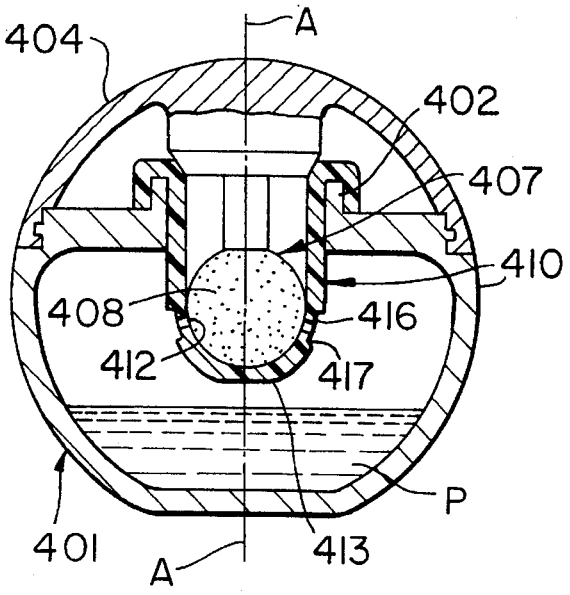
FIG. 9 is a partial cross sectional view of a device in another embodiment of the invention.

FIG. 9 illustrates another embodiment of the invention in which slits 412 are situated at the bottom of a groove 417 in a pouch 408 as in the embodiment of FIGS. 7 and 8. A container 401 includes a bowl formed with a partially spherical region. A cover or stopper 404 constitutes a partially spherical cap which, in the sealed position, completes the partial sphere shape of the container 401. A neck 402 of the container 401 has a reduced axial extent and a pouch 410 extends inside the container 401 beyond the neck 402. In the sealed position of the stopper 404 the applicator member 407 exerts an axial thrust against a bottom 413 of the pouch 410 so as to open the slits 412.

Figure 10:
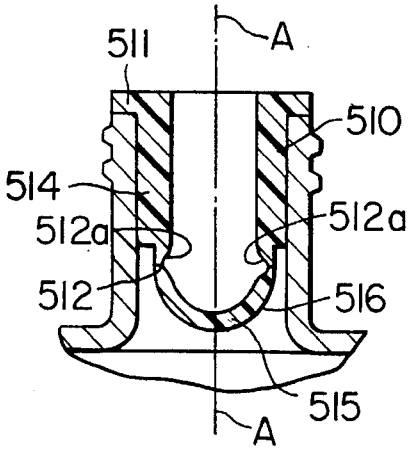
FIG. 10 illustrates a cross sectional view of another embodiment of the invention having a pouch with a thinned end wall.

FIG. 10 illustrates another embodiment of the invention in which a wall of a pouch 510 has a region 516 of reduced thickness which forms a hemispherical bottom 515 of the pouch 510, while an upper part 514 of the pouch 510 is cylindrical. Slits 512 in the pouch 510 are provided in the region 516 of lesser thickness, in the vicinity of the junction with the cylindrical part 514 of greater thickness. The slits 512 are situated in a plane orthogonal to the axis A—A. These slits 512 are closed in an at rest position, as shown in FIG. 10, and open under the effect of an axial thrust against the bottom 515 of the pouch 510. This thrust is created by an applicator member when the stopper (not shown) is placed in its sealed position.

Preferably, depending on the thickness of the pouch 510, the edges **512*a* of the slits 512 (that is to say the edges formed at the intersection of the slits 512 and a plane including the axis of the pouch 510) are bevelled so that they are divergent in a direction from the outside of the pouch 510 towards the inside. As viewed in the cross section of FIG. 10, this creates a triangular shaped space partially surrounding the axis of the pouch to trap product between the edges 512*a* and form a micro-reserve of product. If the thickness of the wall of the pouch 510 where the slits are positioned is increased, a greater amount of product is trapped. When the slits 512 close after opening, the product positioned between the edges 512*a* of the slits 512 flows toward the inside of the pouch 510, where an applicator is located, because of the slope of the edges 512*a*. This configuration ensures that the product positioned between the edges 512*a* when the slits 512 are open flows into the pouch 510**. This arrangement, namely slits having bevelled edges, may be adopted in any embodiment.

Figure 11:
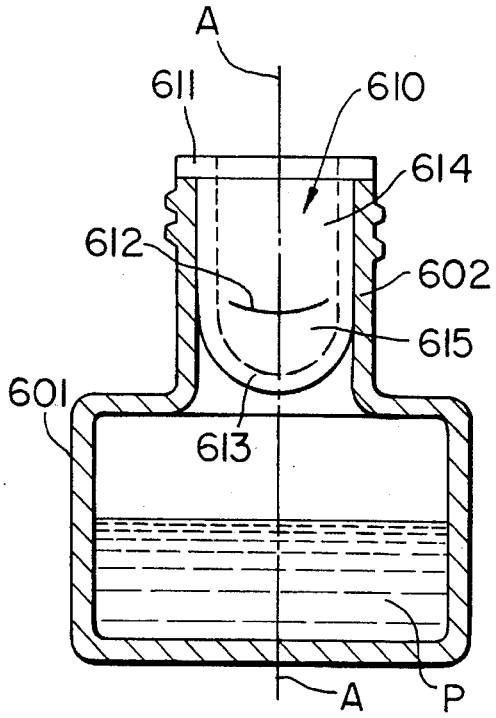
FIG. 11 illustrates a partial cross sectional view, with parts viewed from the outside, of another embodiment of the invention in the open position with a slit of a pouch being closed.
Figure 12:
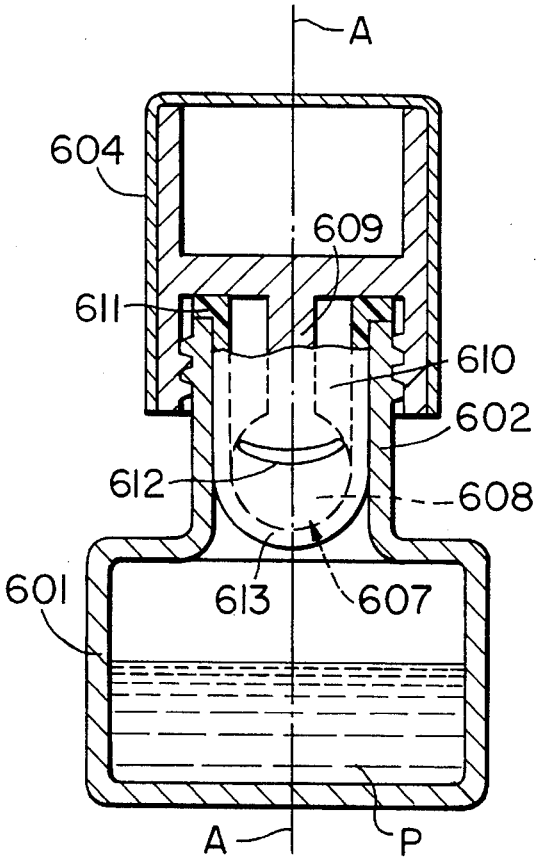
FIG. 12 illustrates a partial cross sectional view of the device of FIG. 11 with the slit being opened by an applicator member.

FIGS. 11 and 12 illustrate another embodiment in which a constant thickness pouch 610, in the shape of a thimble, includes an upper cylindrical part 614 connected to a hemispherical bottom 615. Slits 612 are provided in the pouch 610 at the region of the junction between the cylindrical part 614 and the bottom 615. The slits 612 have a slightly curved shape with their concavity pointing towards the outlet orifice of a neck 602 of container 601. The average directional line of the slits 612 is substantially orthogonal to the axis A—A.

At rest the slits 612 are closed. Under the effect of a substantially axial thrust exerted by an applicator 607 when a stopper 604 is sealed (as illustrated in FIG. 12), the slits 612 become partially open and thus allow an applicator 608 to be impregnated with the product P.

Figure 13:
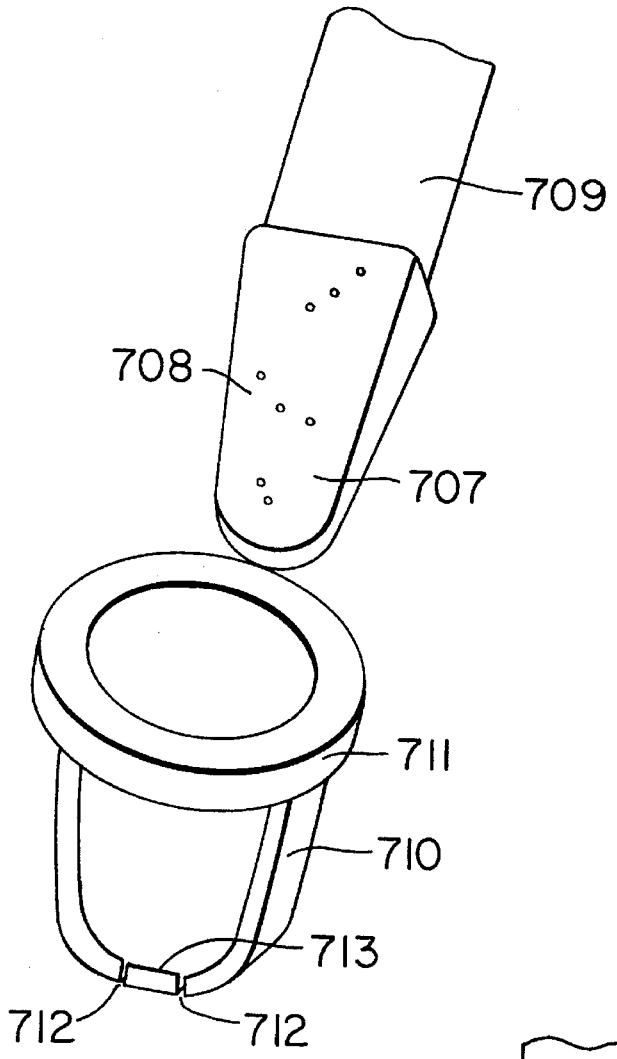
FIG. 13 illustrates a perspective view of another embodiment of the invention with an applicator having a planar configuration.
Figure 14:
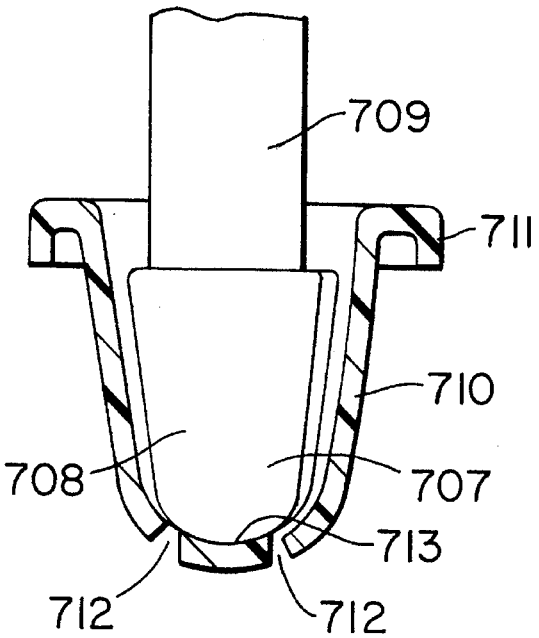
FIG. 14 illustrates a partial cross sectional view of the device of FIG. 13 with the slits of the pouch being opened by the applicator member.

In another embodiment, shown in FIGS. 13 and 14, an applicator 707 and a pouch 710 have a planar frustoconical shape. In other words they have a frustoconical shape with a flattened cross-section, for example a semi-oval crosssection having a high eccentricity (i.e. a high ratio between the major axis and the minor axis of the cross-section). As shown in FIGS. 13 and 14, the applicator 707 may have a planar shape tapered with a width decreasing from the support rod 709 towards a tip of the applicator 707; this depicted shape has the shape and taper of an ice lolly. The inlet of the pouch 710 at collar 711 may be cylindrical, while a lower part of the pouch 710 may have a flattened transverse cross-section, for example a semi-oval cross-section.

As shown in FIG. 13 slits 712 positioned adjacent to a bottom wall 713 of the pouch 710 are closed in an at rest position. When applicator member subjects the wall of the pouch to a thrust force, as shown in FIG. 14, the slits 712 open. Thus product may flow through the open slits and impregnate the wad 708.

It will be apparent to those skilled in the art that various modifications and variations can be made to the structure and methodology of the present invention without departing from the scope or spirit of the invention. In view of the foregoing, it is intended that the present invention cover modifications and variations of this invention provided they come within the scope of the following claims and their equivalents.

What is claimed is:

1. A device for dispensing a liquid or powdery product comprising a container for a product, the container having a neck equipped with a pouch made of a deformable elastic substance, the pouch having at least one slit that is substantially closed in an at rest position and capable of opening when subjected to a force; and a stopper for sealing the neck of the container when the stopper is in a sealing position, the stopper being equipped with an applicator member, such that when stopper is in the sealing position the pouch houses the applicator member, the applicator member immerses in the container and the applicator member subjects a wall of the pouch to a thrust force that opens the slit.

2. A device according to claim 1, wherein the thrust force exerted by the applicator member on the wall of the pouch when the stopper is in the sealing position comprises a component orthogonal to an axis of the neck of the containers, the slit provided in the pouch has a component situated in the same plane as an axis of the pouch and the applicator member has transverse dimensions such that, when the container is sealed with the stopper, the applicator member causes the wall of the pouch to swell out sideways and open the slit.

3. A device according to claim 2, wherein a part of the pouch has a frustoconical shape and the slit is oriented along a generatrix of the frustoconical shape.

4. A device according to claim 1, wherein the thrust force of the applicator member on the wall of the pouch when the stopper is in the sealing position comprises a component oriented along an axis of the neck of the container, the slit has a component in a direction orthogonal to an axis of the pouch, and when the stopper is in the sealing position the applicator member comes into abutment against a bottom of the pouch to create the thrust force and cause the slit to open.

5. A device according to claim 2, wherein the slit of the pouch has a V-shape, the V-shape of the slit being substantially symmetrical relative to a plane including the axis of the pouch.

6. A device according to claim 4, wherein the slit of the pouch has a V-shape, the V-shape of the slit being substantially symmetrical relative to a plane including the axis of the pouch.

7. A device according to claim 5, wherein the V-shaped slit has a tip pointing towards an outlet of the container.

8. A device according to claim 6, wherein the V-shaped slit has a tip pointing towards an outlet of the container.

9. A device according to claim 2, wherein the pouch has the shape of a substantially cylindrical thimble with a rounded internal end.

10. A device according to claim 4, wherein the pouch has the shape of a substantially cylindrical thimble with a rounded internal end.

11. A device according to claim 9, wherein the slit has the shape of an arc of a curve, the average direction of the slit being orthogonal to the axis of the pouch.

12. A device according to claim 10, wherein the slit has the shape of an arc of a curve, the average direction of the slit being orthogonal to the axis of the pouch.

13. A device according to claim 11, wherein the slit has a shape with a convexity facing towards an outlet orifice of the neck.

14. A device according to claim 12, wherein the slit has a shape with a convexity facing towards an outlet orifice of the neck.

15. A device according to claim 11, wherein the slit has a slightly curved shape with a concavity facing towards an outlet orifice of the neck.

16. A device according to claim 12, wherein the slit has a slightly curved shape with a concavity facing towards an outlet orifice of the neck.

17. A device according to claim 1, wherein the wall of the pouch has e region of reduced thickness, the slit being provided in the region of reduced thickness in a plane substantially orthogonal to an axis of the pouch.

18. A device according to claim 2, wherein the wall of the pouch has a region of reduced thickness, the slit being provided in the region of reduced thickness in a plane substantially orthogonal to an axis of the pouch.

19. A device according to claim 3, wherein the wall of the pouch has a region of reduced thickness, the slit being provided in the region of reduced thickness in a plane substantially orthogonal to an axis of the pouch.

20. A device according to claim 4, wherein the wall of the pouch has a region of reduced thickness, the slit being provided in the region of reduced thickness in a plane substantially orthogonal to an axis of the pouch.

21. A device according to claim 17, wherein the region of reduced thickness of the pouch forms a groove creating a reserve for the product, the slit being provided in the bottom of the groove.

22. A device according to claim 18, wherein the region of reduced thickness of the pouch forms a groove creating a reserve for the product, the slit being provided in the bottom of the groove.

23. A device according to claim 19, wherein the region of reduced thickness of the pouch forms a groove creating a reserve for the product, the slit being provided in the bottom of the groove.

24. A device according to claim 20, wherein the region of reduced thickness of the pouch forms a groove creating a reserve for the product, the slit being provided in the bottom of the groove.

25. A device according to claim 1, wherein the pouch and the applicator member have a shape including one of a planar frustoconical shape and a planar shape tapered like an ice lolly.

26. A device according to claim 2, wherein the pouch and the applicator member have a shape including one of a planar frustoconical shape and a planar shape tapered like an ice lolly.

27. A device according to claim 4, wherein the pouch and the applicator member have a shape including one of a planar frustoconical shape and a planar shape tapered like an ice lolly.

28. A device for dispensing a liquid or powdery substance, the device comprising:

a container including an interior for containing a product and a neck having a passage to the interior of the container;

a pouch made of an elastic substance, the pouch being arranged in the passage of the neck with a closed end thereof within the container, the pouch having a wall with at least one slit being substantially closed in an at rest position: the pouch containing the product within the container when the slit is closed;

a removable stopper for cooperating with the neck to seal the passage; and an applicator for applying the product, the applicator extending from the stopper such that when the stopper seals the passage the applicator extends into the pouch and applies a force to the wall of the pouch that opens the slit.

29. The device of claim 28, wherein the neck includes a first thread on a surface of the neck and the stopper includes a second thread mateable with the first thread such that the stopper may be threaded onto the neck to seal the passage.

30. The device of claim 28, wherein the applicator includes a wad made of a material capable of being impregnated with the product, the wad contacting the wall of the pouch to apply the slit opening force when the stopper seals the container.

31. The device of claim 28, wherein the pouch includes a collar arranged at an open end of the neck and the stopper includes a wall that contacts the collar, such that the collar forms a seal with the wall for the passage.

32. A method of dispensing a product from a container having a neck portion, the method comprising the steps of:

placing an applicator extending from a stopper into a deformable elastic pouch, positioned in the neck of the container, the pouch having at least one slit being substantially closed in an at rest position, the placing step including the substeps of:

sealing the neck of the container with the stopper, and opening the slit in the pouch by allowing the applicator to apply a force to the pouch;

flowing product in the container through the open slit and onto the applicator;

removing the stopper and applicator from the container while allowing the slit to close; and applying the product to a desired surface with the applicator.

* * * * *

UNITED STATES PATENT AND TRADEMARK OFFICE

CERTIFICATE OF CORRECTION

PATENT NO. : 5,573,340
DATED : November 12, 1996
INVENTOR(S) : Gueret

It is certified that error appears in the above-indentified patent and that said Letters Patent is hereby corrected as shown below:

Claim 1, col. 7, line 9, "comprising" should read --comprising:--.

Claim 2, col. 7, lines 24-25, "containers," should read --container,--.

Claim 17, col. 8, line 11, "e region" should read --a region--.

Claim 28, col. 8, line 62, "position:" should read --position;--.

Signed and Sealed this

Fourteenth Day of January, 1997

*Attest:*

Bruce Lehman

BRUCE LEHMAN

*Attesting Officer*

*Commissioner of Patents and Trademarks*